US007040358B2

(12) United States Patent
Lacroix et al.

(10) Patent No.: US 7,040,358 B2
(45) Date of Patent: May 9, 2006

(54) NOZZLE WITH SAFE FUNCTIONING AND FILLING INSTALLATION INCORPORATING SUCH A NOZZLE

(75) Inventors: Jean-Jacques Lacroix, Lovagny (FR); Maurice Ravaz, Faverges (FR)

(73) Assignee: Staubli Faverges, Faverges (FR)

( * ) Notice: Subject to any disclaimer, the term of this patent is extended or adjusted under 35 U.S.C. 154(b) by 169 days.

(21) Appl. No.: 10/388,478

(22) Filed: Mar. 17, 2003

(65) Prior Publication Data

US 2003/0178096 A1 Sep. 25, 2003

(30) Foreign Application Priority Data

Mar. 19, 2002 (FR) ..... 02 03388

(51) Int. Cl.
*B65B 1/30* (2006.01)

(52) U.S. Cl. ..... 141/206; 141/208; 222/153.14; 251/149.9

(58) Field of Classification Search ..... 141/206, 141/207, 208, 209, 217, 218, 392; 251/149.9; 222/153.14; 239/525, 526, 527, 528
See application file for complete search history.

(56) References Cited

U.S. PATENT DOCUMENTS 3,012,592 A * 12/1961 Wright et al. ..... 141/208
3,479,005 A * 11/1969 Graaf ..... 251/149.9
3,982,571 A 9/1976 Fenton et al.
4,135,551 A * 1/1979 Knight et al. ..... 251/149.9
4,153,085 A 5/1979 Adams
4,426,063 A * 1/1984 Bormioli ..... 251/149.9
5,078,170 A * 1/1992 Henry ..... 137/614.06
5,421,382 A 6/1995 Leininger et al.
5,904,302 A 5/1999 Brown
6,009,901 A * 1/2000 Roberts ..... 137/614.06
6,298,876 B1 * 10/2001 Bogdonoff et al. .... 137/614.06

FOREIGN PATENT DOCUMENTS

| | | |
|---|---|---|
| EP | 0286353 | 10/1988 |
| GB | 1210922 | 11/1970 |

* cited by examiner

*Primary Examiner*—Gregory L. Huson
*Assistant Examiner*—Khoa D. Huynh
(74) *Attorney, Agent, or Firm*—Dowell & Dowell, P.C.

(57) ABSTRACT

A pressurized fluid filling nozzle provided with a ring for fastening on an adaptor connected to a container and with a controlled valve adapted to selectively control flow of fluid through a conduit. A sensor detects the fastening of the nozzle on the adaptor and makes it possible to render a kinematic link between a control member and the valve active to displace the valve from a position where it obturates the conduit towards a position where it leaves a passage free for fluid flow. The control member is a trigger provided with at least one profiled guide which comprises two parts which cooperate with a guide element of a lever articulated on the valve. Depending on a position of the guide element, a transmission of force between the trigger and the valve is, or is not, possible.

12 Claims, 4 Drawing Sheets

NOZZLE WITH SAFE FUNCTIONING AND FILLING INSTALLATION INCORPORATING SUCH A NOZZLE

BACKGROUND OF THE INVENTION

1. Field of the Invention

The present invention relates to a nozzle for filling a container with a fluid under pressure. The invention also relates to an installation for filling an automobile vehicle tank with liquefied petroleum gas, in which such a nozzle is used.

2. Description of the Related Art

It is known, for example from U.S. Pat. No. 5,904,302, to use a bayonet-type system for ensuring fixation of a kerosene filling adaptor on an aircraft. As a function of the interlocking, a lever may block a valve located in this adaptor. Such bayonet-type interlocking is delicate to carry out and the use of this complex system is, in practice, reserved for specialists working in airport zones.

In the domain of the dispensing of liquefied petroleum gas (LPG) as fuel for automobile vehicle, it is known that serious precautions must be taken to avoid gas spreading in the ambient atmosphere. In particular, it is imperative that a tight connection be made between the dispensing device, or pump, and the tank of the vehicle. In the known devices, the user must place an end adaptor of a flexible hose pipe on an adaptor located on the vehicle then activate a lever to lock these adaptors. The user must then return to the pump to control an electrovalve allowing the hose pipe to be supplied with gas under pressure. These known steps are not convenient and can disconcert an inexperienced user.

In addition, in the known devices, interlocking of the end of the hose pipe on the adaptor of the vehicle is generally effected thanks to a claw system which is complex, and consequently unreliable. Such a claw system may be poorly engaged on the adaptor of the vehicle, hence a risk of offset connection that may lead to leakages of gas.

The devices used in the domain of filling automobile vehicle tanks with LPG must, in addition, be compatible with the standardized adaptors mounted on the vehicles.

It is a particular object of the present invention to overcome these limitations by proposing a nozzle for filling a container, particularly adapted to the dispensing of LPG, which makes it possible to deliver a fluid in tight manner, while ensuring that no fluid is spread in the atmosphere as long as the nozzle is not connected to the adaptor with which it must cooperate, even if the user exerts an effort on the trigger.

Another object of the invention is to propose a nozzle such that the rejects of fluid when it is disconnected from the adaptor are minimized.

SUMMARY OF THE INVENTION

To that end, the present invention relates to a nozzle for filling a container with a fluid under pressure, this nozzle being provided with a means for fastening on an adaptor connected on the container, with a controlled valve adapted to selectively obturate a conduit for flow of the fluid, and with a sensor detecting the fastening of the nozzle on an adaptor. The sensor is adapted, as a function of this fastening, to render active a kinematic link between a control member and the valve, this link making it possible, in active configuration, to displace the valve from a position where it obturates the conduit towards a position where it leaves a passage free for the fluid in this conduit, while, in non-active configuration of the link, the valve cannot be actuated by means of the afore-mentioned member. The kinematic link comprises a lever, articulated on the valve, between a first position where it is not displaceable by the control member and a second position where it may be displaced by this member, taking along the valve, the sensor being adapted to displace the lever from its first towards its second position. The control member is a trigger articulated on the nozzle and provided with at least one cut-out, notch or groove whose profile forms a first part which makes it possible to receive an element secured to the lever without noteworthy interaction between the lever and the trigger. The cut-out, groove or notch also comprises a second part which has a geometry different from the first part and extends it, the element secured to the lever being adapted to slide along the profile of the first part of the cut-out, groove or notch, when the lever is in its first position, and to cooperate with the profile of the second part, when the lever is in its second position, with the result that it allows the transmission of a force between the trigger and the lever.

Thanks to the invention, the kinematic link between the control trigger and the valve prevents the nozzle from allowing passage as long as it is not fastened on an adaptor. Fastening is detected thanks to the lever which is secured to an element allowing the trigger to be passed from a configuration where it is "idle" to a configuration where it is "active". In the idle configuration, the afore-mentioned element cooperates with the profile in its first part, while it cooperates with the profile in its second part when the trigger is in active configuration.

According to advantageous but non-obligatory aspects of the invention, a nozzle may incorporate one or more of the characteristics set forth in the dependent claims.

The invention also relates to an installation for filling an automobile vehicle tank with liquefied petroleum gas, which incorporates a nozzle as described hereinabove and envisaged hereinafter.

BRIEF DESCRIPTION OF THE DRAWINGS

The invention will be more readily understood on reading the following description of a form of embodiment of a nozzle and of an installation in accordance with its principle, given solely by way of example and made with reference to the accompanying drawings, in which.

DESCRIPTION OF PREFERRED EMBODIMENT

Figure 1:
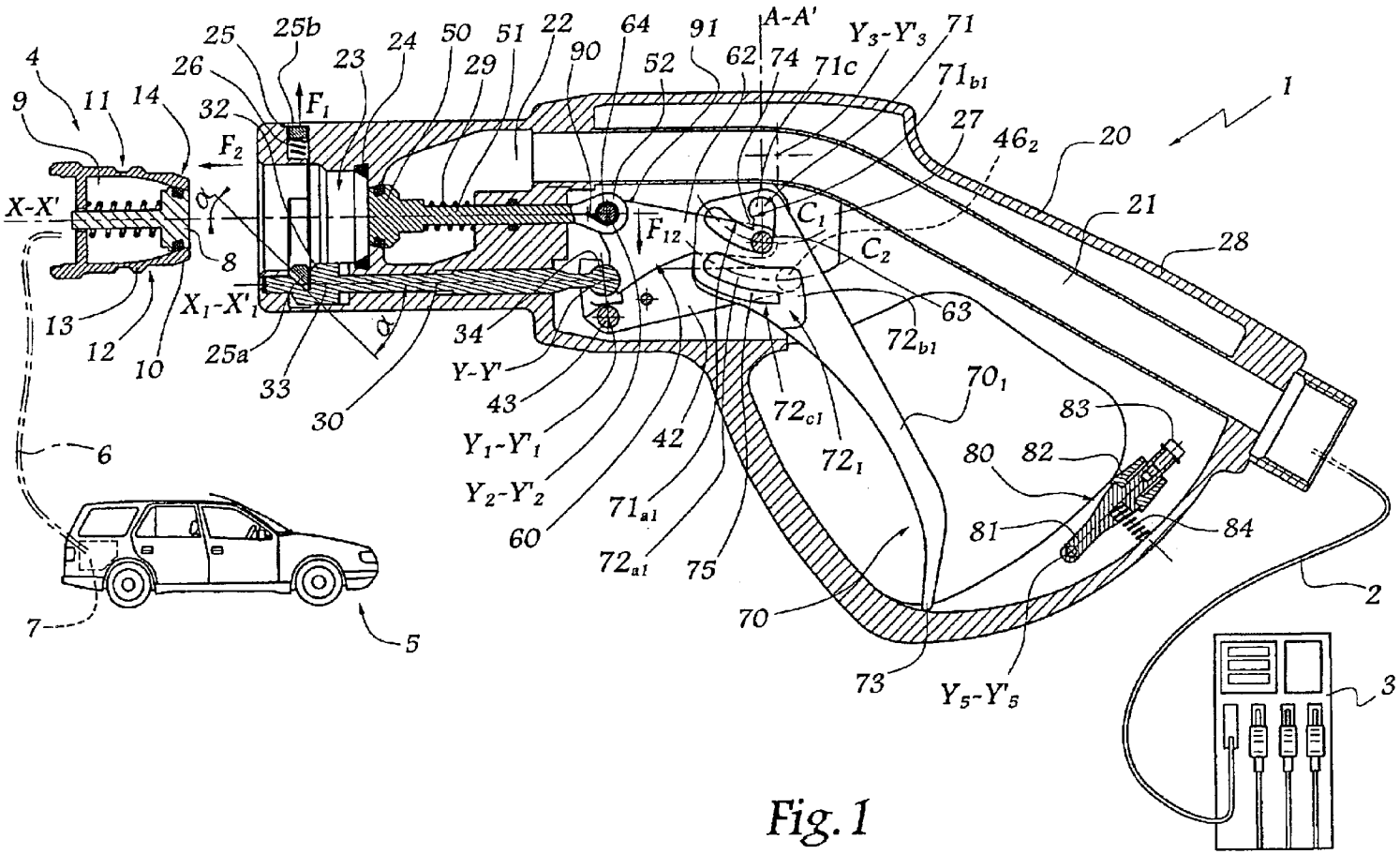
FIG. 1 schematically shows an installation according to the invention of which the nozzle and the adaptor with which it cooperates are shown in longitudinal section.

Referring now to the drawings, the nozzle 1 shown therein is connected on the downstream end of a flexible hose pipe 2 of which the upstream end is connected to a pump 3 for dispensing liquefied petroleum gas.

The nozzle 1 is intended to cooperate with adaptors such as the adaptor 4 shown in the Figures which is mounted on an automobile vehicle 5 and which is connected, via a conduit 6 integrated with the vehicle 5, to a liquefied gas tank 7.

The adaptor 4 is equipped with a valve 8 elastically loaded by a spring 9 in the direction of a part 10 of the adaptor 4 forming seat.

On its outer peripheral surface, the adaptor 4 is provided with a groove 11 of flared shape as well as with an indent 12 separated from the groove 11 by a flange 13.

The nozzle 1 comprises a body 20 inside which is housed a pipe 21 connected to an angle 22 of which the opening 22*a* in the form of a convergent part communicates with a volume or chamber 23 for receiving the adaptor 4 in the body 20. The volume 23 has a shape adapted to the outer shape of the adaptor 4 and is equipped with an O-ring 24 for abutment of an end bevel 14 of the adaptor 4. Around the volume 23, the nozzle 1 is equipped with a fastening element in a form of a ring 25 for retaining the adaptor 4 in the volume 23. This ring 25 is elastically loaded by a spring 26 exerting thereon an effort $F_1$ perpendicular to a longitudinal axis X–X' of the adaptor 4 and of the volume 23 when the latter are opposite or engaged with respect to each other, as represented in the Figures.

Figure 2:
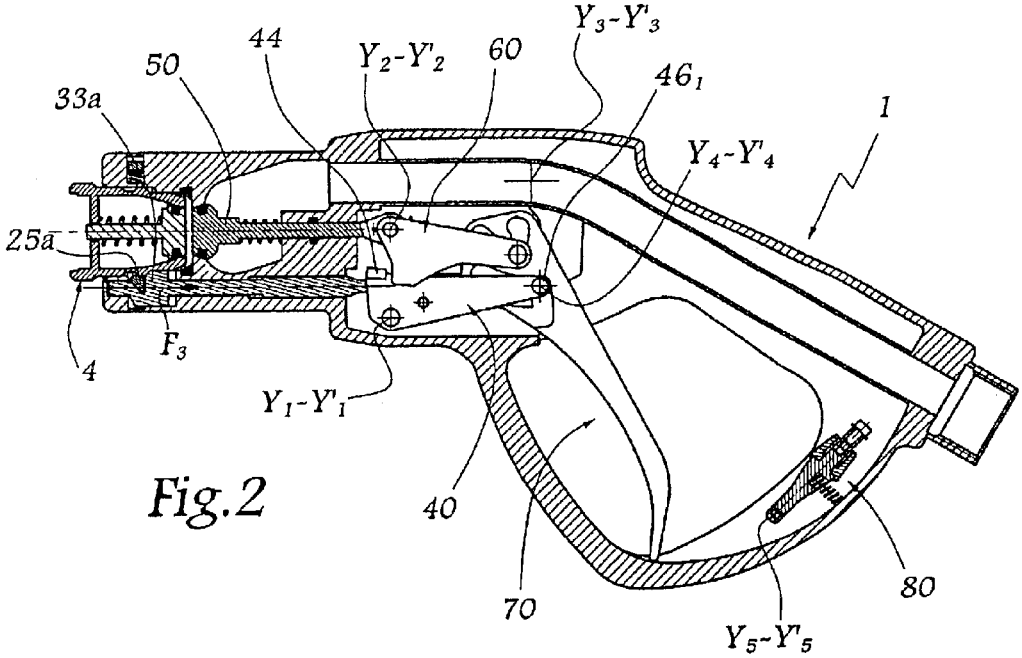
FIG. 2 is a view on a smaller scale of the nozzle and the adaptor of FIG. 1, when the nozzle is being fastened on the adaptor.
Figure 3:
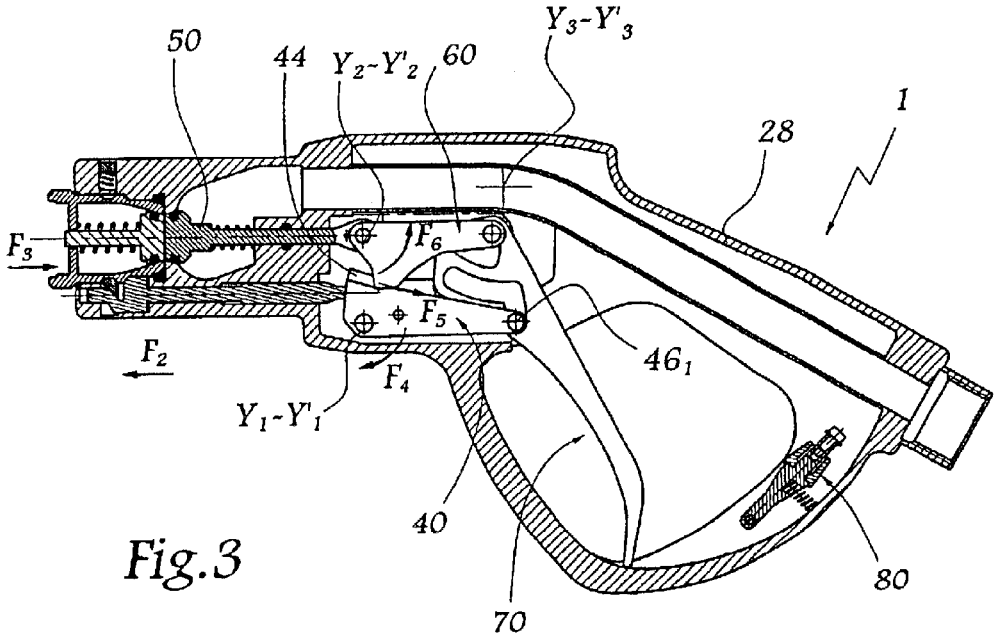
FIG. 3 is a view similar to FIG. 2, when the nozzle is fastened on the adaptor.
Figure 4:
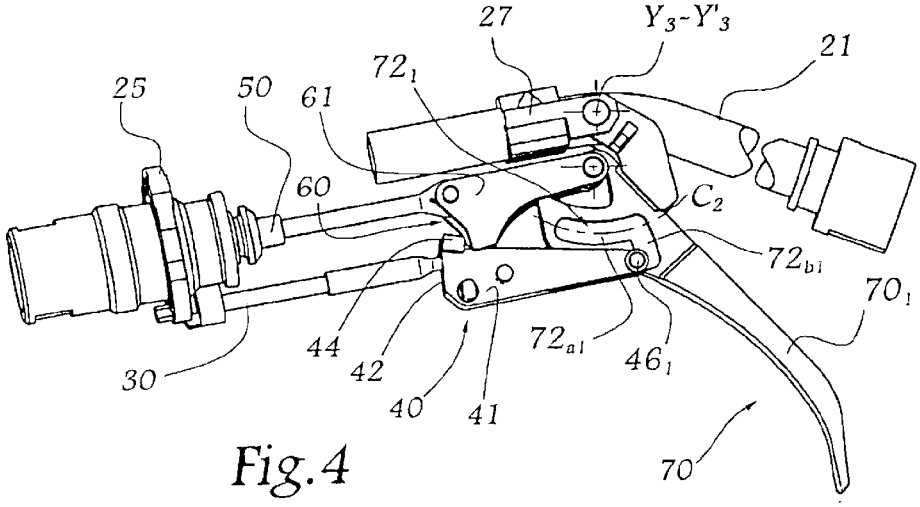
FIG. 4 is a view in perspective of the adaptor and of the internal elements of the nozzle in the configuration of FIG. 3.

When the nozzle 1 is displaced towards the adaptor 4 in the direction of arrows $F_2$ in FIGS. 1 to 3, the flange 13 pushes the ring 25 against the effort $F_1$, as represented in FIG. 2, then the ring 25 engages in the groove 13, under the effect of the effort $F_1$, as represented in FIG. 3.

The elements 25 and 26 therefore constitute means for fastening the nozzle 1 on the adaptor 4.

A rod 30 is mounted, with the possibility of slide parallel to axis X–X', in a housing 31 made in the body 20. This rod 30 comprises a nose 32 intended to come into engagement in the indent 12 of the adaptor 4. This rod also comprises a notch 33 for partially receiving a part 25*a* of the ring 25 opposite a part 25*b* on which the effort $F_1$ is exerted. The rod 30 functions as a sensor for indicating when the adapter 4 is fully seated within the chamber 23 of the nozzle.

At its end 34 opposite the parts 32 and 33, the rod 30 is articulated, about a geometrical axis Y–Y', on a rocker 40 formed by two plates 41 and 42 embracing the end 34 and articulated on the body 20 about a geometrical axis $Y_1$–$Y'_1$ perpendicular to axis X–X', this axis being materialized by a pin 43 traversing the plates 41 and 42. Each of the plates 41 and 42 is provided with a heel 44, 45, respectively, of substantially parallelepipedic shape.

A valve 50 is mounted in the angle 22 and comes into abutment, under the effect of an elastic effort exerted by a spring 29, against the convergent part 22*a* forming the downstream part of the angle 22.

The valve 50 is extended by a rod 51 articulated about an axis $Y_2$–$Y'_2$ with a lever 60 formed by two plates 61 and 62 embracing the end 52 of the rod 51. The axes $Y_1$–$Y'_1$ and $Y_2$–$Y'_2$ are parallel.

The plates 61 and 62 have such a geometry that they come respectively opposite the heels 44 and 45.

Figure 5:
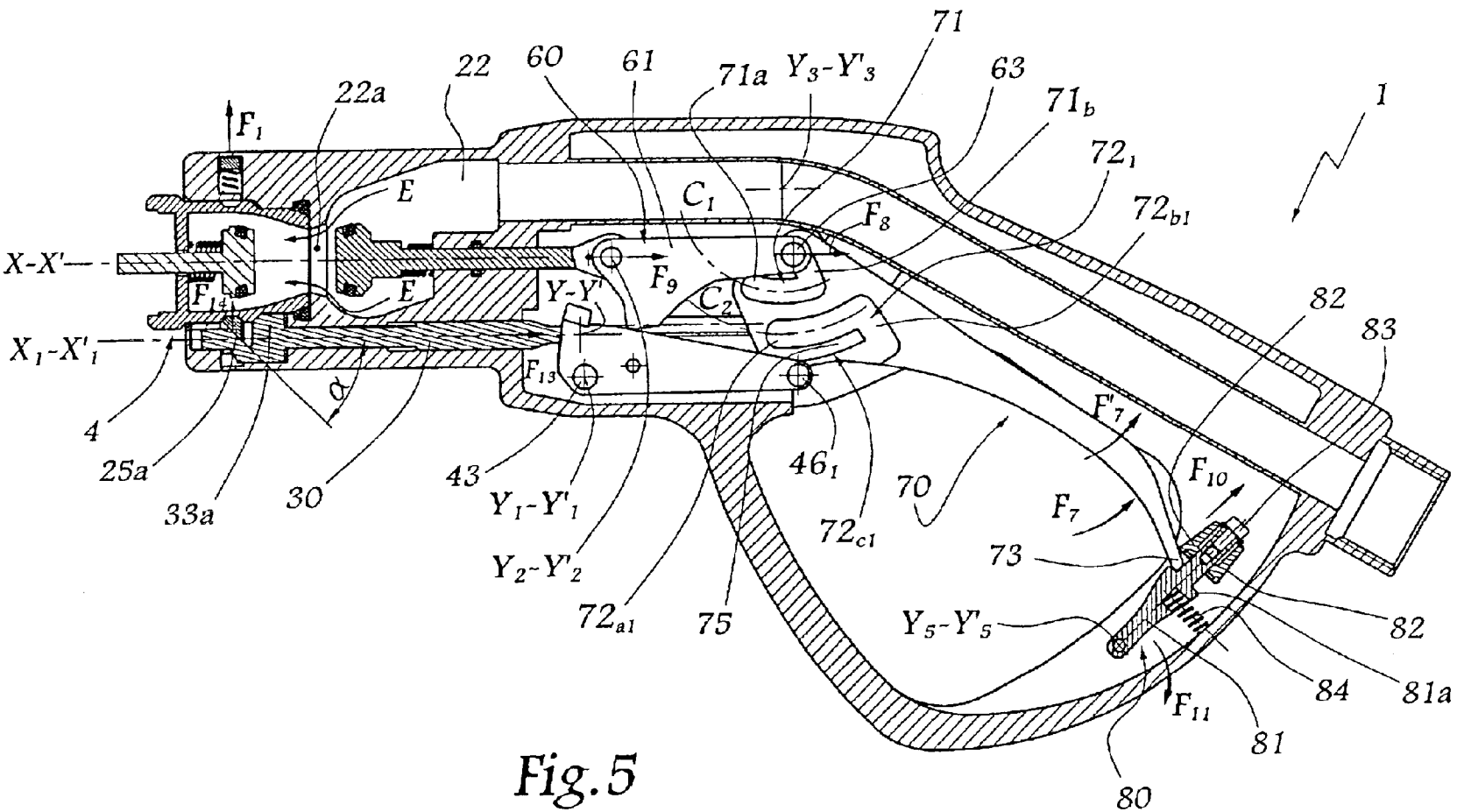
FIG. 5 is a view similar to FIG. 2 and to the scale of FIG. 1, when the trigger of the nozzle is controlled so that fluid flows.

The plates 41 and 61 have been added in FIGS. 2, 3 and 5 in order to render the drawing clearer.

Furthermore, a cylindrical guide pin or element 63 with circular cross-section is mounted through the plates 61 and 62 along an axis parallel to axis $Y_2$–$Y'_2$.

A trigger 70 is articulated on a support 27 secured to the pipe 21. $Y_3$–$Y'_3$ denotes the axis of articulation of the trigger 70, this axis being parallel to axis $Y_1$–$Y'_1$.

The trigger 70 is provided with a profiled guide notch 71 which the guide pin 63 traverses and in which it may move.

The profile of this notch comprises a first part shaped as an arc of circle $C_1$ centered on axis $Y_3$–$Y'_3$. In this direction, part 71*a* is in the form of an arc of circle. The notch 71 also comprises a second part 71*b* with which part 71*a* communicates and which extends in a direction A–A' substantially perpendicular to part 71*a* in joint between these parts. The bottom of the part 71*b* forms a seat 71*c* in which the pin 63 may be retained.

The trigger 70 is also provided, on its face $\mathbf{70}_1$ visible in FIGS. 1 to 5, with a groove notch or recess 72 which comprises a first part $\mathbf{72}a_1$ substantially in the form of an arc of circle $C_2$ centered on axis $Y_3$–$Y'_3$, as well as a second, L-shaped part $\mathbf{72}b_1$ which communicates with the part $\mathbf{72}a_1$. A guide pin or element $\mathbf{46}_1$ is mounted on the plate 41 and extends, along axis $Y_4$–$Y'_4$ parallel to axis $Y_1$–$Y'_1$, towards the groove $\mathbf{72}_1$. The pin $\mathbf{46}_1$ is intended to slide in the groove $\mathbf{72}_1$.

Figure 6:
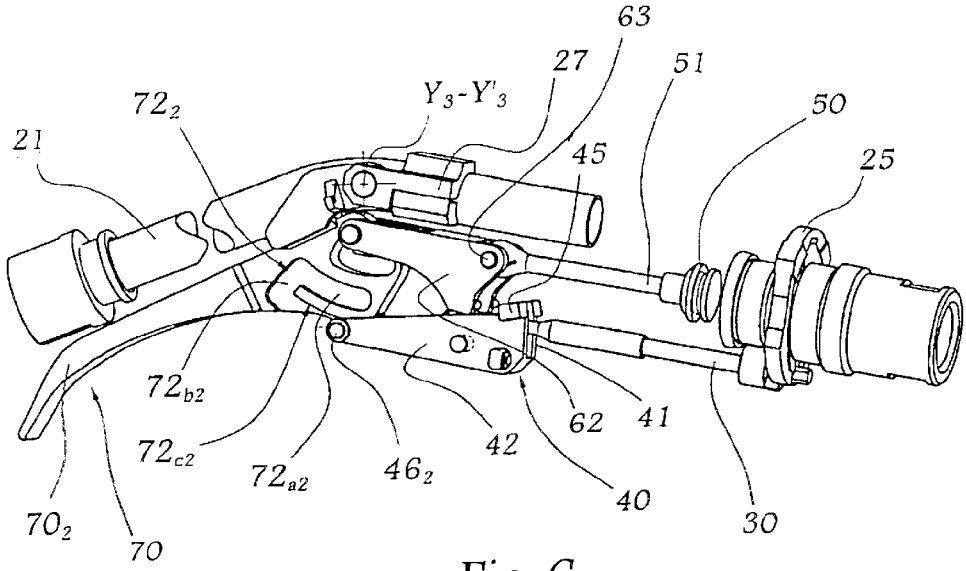
FIG. 6 is a view of the type of FIG. 4 when the nozzle is in the configuration of FIG. 5.

On its opposite face $\mathbf{70}_2$, visible in FIG. 6, the trigger 70 is provided with a second groove $\mathbf{72}_2$ having the same geometry as the groove $\mathbf{72}_1$, with an arcuate part $\mathbf{72}_{b2}$ and an L-shaped part $\mathbf{72}_{a2}$. The plate 42 bears a guide pin or element $\mathbf{46}_2$ intended to slide in the groove $\mathbf{72}_2$.

Functioning is as follows:

When the nozzle 1 is fastened on the adaptor 4, as explained hereinabove, the nose 32 of the rod 30 is pushed in the direction of arrow $F_3$ in FIG. 3, which has the effect of causing the rod 30 to slide in the housing 31, in the direction of this arrow, a corresponding displacement of the end 34 being obtained. Such displacement has the effect of causing the rocker 40 to pivot about axis $Y_1$–$Y'_1$ in the direction of arrow $F_4$, to such a point that heels 44 and 45 come into abutment against the plates 61 and 62, which induces a pivoting of the lever 60 in the trigonometric direction in FIG. 3. The bearing effort of the heels 44 and 45 on the lever 60 is represented by arrow $F_5$ in FIG. 3, while the pivoting of this lever is represented by arrow $F_6$. Due to the pivoting of the lever 60, the pin 63 which, in the configuration of FIG. 1, is engaged in the part 71*a* of the groove 71, is displaced towards the part 71*b* in the direction of the seat 71*c*.

In this configuration, if the user exerts on the trigger 70 an effort $F_7$ towards the part forming handle 28 of the body 20, the trigger exerts, by the front edge $\mathbf{71}b_1$ of part 71*b* and on the pin 63 borne by the lever 60, an effort $F_8$ of traction resulting in a corresponding effort of traction $F_9$ on the valve, this effort having the effect of detaching the valve 50 from the convergent part 22*a*. This allows a flow E of fluid under pressure from its source 3 towards the tank 7 connected to the adaptor 4.

If the trigger 70 is released, the spring 29 pushes the valve 50 towards its seat 22*a*.

A device 80 is provided for temporarily blocking the trigger 70 in the configuration of FIG. 5. This device comprises an arm 81 articulated on the body 20 about an axis $Y_5$–$Y'_5$ parallel to axis $Y_1$–$Y'_1$ and a shuttle 82 mounted to slide on the arm 81 and retained in position thanks to a screw 83.

When the trigger 70 is subjected to the effort $F_7$, it displaces the shuttle 82 in the direction of arrow $F_{10}$ in FIG. 5, with the result that it is blocked against an outer radial shoulder 81*a* of the arm 81. When the flow E is to be stopped, an additional effort $F'_7$, of the same direction as effort $F_7$ but of greater intensity, may be exerted, which has the effect of bringing, by an overtravel, the shuttle 82 into abutment against the head of the screw 83, then of pivoting the arm 81 in the direction of arrow $F_{11}$ against an elastic effort exerted by a spring 84. The end 73 of the trigger 70 is then released with respect to the arm 81, the trigger 70 in that case being able to return towards the position of FIG. 3.

In this way, when the nozzle 1 is fastened on the adaptor 4, the flow of fluid can be controlled thanks to the trigger 70.

If the effort $F_7$ is exerted on the handle 70 in the configuration of FIG. 1, the pin 63 slides in the part 71*a* of the notch 71 without an effort of traction being transmitted to the lever 60, with the result that the valve 50 remains in abutment against its seat formed by the convergent part 22*a*. In this configuration, the edge $71a_1$ of part 71*a* closest to the axis $Y_3$–$Y'_3$ essentially defines the path of slide of the pin 63.

The active parts of the notch 71 are thus the edges $71a_1$ and $71b_1$ which are defined by the profile of a solid part 74 of the trigger 70.

Thus, it is not possible to manipulate the valve 50 as long as the kinematic link between the trigger 70 and the valve is not rendered active by the displacement of the lever 60 towards its position in which the pin 63 is engaged in part 71*b* of the notch 71.

A torsion spring 90 is disposed around the pin 64 constituting the physical axis of articulation between the end 52 of the valve 50 and the plates 61 and 62 of the lever 60, with the result that the end 91 of this spring exerts on the lever 60 an effort $F_{12}$ tending to return the lever 60 towards its position of FIG. 1.

In addition, the cooperation of the pins $46_1$ and $46_2$ and of the grooves $72_1$ and $72_2$ function as a lock which prevents a separation of the nozzle 1 and of the adaptor 4 when the valve 50 is open as shown in FIG. 5. In effect, when the pin 63 slides in the part 71*a* of the notch 71, the pins $46_1$ and $46_2$ may slide in the parts $72a_1$ and $72a_2$ of the grooves $72_1$ and $72_2$. On the other hand, when the heels 44 and 45 push the lever 60, as represented by arrow $F_5$ in FIG. 3, the pivoting $F_4$ of the rocker 40 has the effect of taking pins $46_1$ and $46_2$ in the parts $72b_1$ and $72b_2$ of the notches $71_1$ and $72_2$. Due to the displacement of the trigger 70 under the effect of the effort $F_7$, the pins $46_1$ and $46_2$ then each slide along a lateral surface $72c_1$, $72c_2$, respectively, of the notches $72_1$ and $72_2$. The pins $46_1$ and $46_2$ are in that case in abutment against the surfaces $72c_1$ and $72c_2$, with the result that the rocker 40 can no longer pivot about axis $Y_1$–$Y'_1$ in a direction opposite to arrow $F_4$.

The rocker 40 thus being locked by its cooperation with surfaces $72c_1$ and $72c_2$ in a configuration where its pins $46_1$ and $46_2$ are lowered, it exerts on the rod 30 an effort of traction $F_{13}$ which has the effect of firmly applying a surface 33*a* defining the notch 33 against a surface 25*c* of the ring 25.

The surface 33*a* is inclined by an angle $\alpha$ equal to about 45° with respect to a longitudinal axis $X_1$–$X'_1$ of the rod 30 which is parallel to axis X–X'. As for the surface 25*c*, it is inclined by the same angle $\alpha$ with respect to the axis X–X', axes $X_1$–$X'_1$ and X–X' being parallel to each other.

The effort $F_{13}$ is thus transmitted to the ring 25 in the form of an effort $F_{14}$ of the same direction and same sense as the effort $F_1$, this effort firmly maintaining the ring 25 in engagement in the groove 11.

In this way, it is impossible to withdraw the nozzle 1 from the adaptor 4 as long as the pins $46_1$ and $46_2$ remain respectively in abutment against the surfaces $72c_1$ and $72c_2$, i.e. as long as it is possible to move the valve 50 by manipulating the trigger 70.

It will be noted that the valves 8 and 50 are in surface abutment against each other, which contributes to the seal of the coupling made between the elements 1 and 4. It is also noted that the valve 8 is pushed downstream under the effect of the pressure of the fluid circulating in the pipe 21 and in the angle 22.

The invention has been described with reference to its use in an installation for supplying LPG to an automobile vehicle, which is particularly advantageous. However, a nozzle according to the invention may be used in other types of installation supplying fluid under pressure in which a high degree of safety is sought.

The invention has been shown with levers or rockers 40 and 60 formed by two plates embracing the parts 34 or 52 with which they cooperate. Levers formed in one piece may be envisaged.

The invention has been shown with a notch 71 and grooves $72_1$ and $72_2$ functioning as profiled guides, but it may be carried out with a trigger provided with a notch of equivalent geometry in place of the grooves and/or with grooves in place of the notch. The possible grooves may be made on one face only of the trigger 70. The geometry of the grooves and notches is not limited to that shown in the Figures. In practice, the functional parts of these grooves are essentially the seat 71*c* and the bearing surfaces $72_1$ and $72c_1$. The other parts of these grooves are clearances intended to allow the displacement of the pins $46_1$, $46_2$ and 63, such clearances being able to take various shapes.

The invention has been shown with a notch 71 inscribed in the trigger 70 and having a substantially constant width which is adapted to the diameter of the pin 63 in order to allow its guiding. In a variant, two grooves may be formed on either side of the trigger 70 to receive fingers borne by the lever 60. According to another variant, the first and second parts 71*a* and 71*b* mentioned above may be formed by a cut-out made around a solid part similar to part 74, such cut-out being able to open out on the front edge of the trigger 70.

In any case, the profile of the cut-out, notch or groove provided on the trigger to receive the element secured to the lever makes it possible to obtain the two "idle" and "active" configurations of the trigger.

In the same way, the grooves $72_1$ and $72_2$ may be replaced by a cut-out or notch which traverses the trigger 70. There again, the profile of this groove, cut-out or notch, which is defined in particular by the surfaces $72c_1$ and $72c_2$ which are adjacent to a central tongue 75, makes it possible to obtain the desired safe functioning.

What is claimed is:

1. A nozzle for filling a container with a fluid under pressure, the nozzle including fastening means for fastening on an adaptor connected to the container, a controlled valve for selectively obturating a conduit through which the fluid under pressure may flow, a sensor detecting fastening of the nozzle to the adaptor, said sensor extending adjacent from said fastening means and operatively engaging a kinematic link connected between a control member and said valve, said kinematic link allowing displacement of said valve from a closed position where it obturates said conduit towards an open position where it opens said conduit, said kinematic link including a lever articulated on said valve between a first position where said lever is not displaceable by said control member and a second position where said lever may be displaced by said control member such that, when said valve is in said closed position and said lever is in said first inactive position, said valve cannot be actuated by said control member, said sensor being configured such that upon said sensor detecting fastening of the nozzle to the adaptor, said sensor displaces said lever from said first inactive position towards said second active position of said lever whereby said valve mayb be moved from said closed position to said open position by said control number, wherein said control member is a trigger articulated on the nozzle and provided with a first profiled guide which forms a first part receiving an element secured to said lever without permitting movement of said lever by said trigger, said profiled guide forms a second part which has a geometry different than that of said first part, said element moves along a profile of said first part when said lever is in said second active position thereof whereby said trigger operates said lever to move said valve to said open position.

2. The nozzle of claim 1, wherein said first profiled guide has a substantially constant width allowing a guiding of said element in abutment on edges defining said first guide profiled.

3. The nozzle of claim 1, wherein said first part is shaped substantially in a form of an arc of a circle centered on an axis of articulation of said trigger.

4. The nozzle of claim 3, wherein said second part extends in a direction substantially perpendicular to said first part from a point of intersection with said first part and forms a seat for retaining said element of said lever.

5. The nozzle of claim 1, including means for elastically returning said lever towards said first position in which said element is engaged in the first part of said groove or notch thereof.

6. The nozzle of claim 1, including means for locking said fastening means on the adaptor when said lever is in said second position thereof.

7. The nozzle of claim 6, wherein said sensor is formed as a rigid rod, said means for locking including a rocker articulated on said rod, said rocker being adapted to exert on said rod a force which is transmitted by said rod to said fastening means to thereby retain said fastening means in a position to retain the nozzle on the adapter.

8. The nozzle of claim 7, wherein said fastening means includes a ring adapted to surround the adaptor and to engage partially in a peripheral groove in the adaptor, said ring being provided with a first surface inclined with respect to a central axis of said ring, said first surface being adapted to come into abutment against a second surface of said rod which is inclined with respect to a direction of movement of said rod, the transmission of the force of said rod towards said ring taking place by abutment between said first and second surfaces.

9. The nozzle of claim 7, wherein said rocker is provided with at least one guide element adapted to cooperate with a second profiled guide provided on said trigger to maintain said rocker in a position where it exerts said force on said rod.

10. The nozzle of claim 7, wherein said trigger includes a second profiled guide which guidingly receives at least one second guide element secured to said rocker, said second profiled guide including a first part for receiving said at least one second guide element such that there is no interaction between said trigger and said rocker and a second part for receiving said at least one second guide element such that, when said trigger is operated to move said lever to said second position thereof, said rocker applies a force to urge said rod toward said fastening means.

11. The nozzle of claim 10, wherein said first part is shaped substantially as an arc of a circle centered on an axis of articulation of said trigger.

12. An installation for filling a tank of an automotive vehicle with liquefied petroleum gas, wherein the installation comprises a source of fluid under pressure and a flow line connected to a nozzle for filling a container with a fluid under pressure, the nozzle including fastening means for fastening on an adaptor connected to the container, a controlled valve for selectively obturating a conduit within the nozzle through which fluid under pressure may flow, a sensor detecting fastening of the nozzle to the adaptor, said sensor extending adjacent from said fastening means and operatively engaging a kinematic link connected between a control member and said valve, said kinematic link allowing displacement of said valve from a closed position where it obturates said conduit towards an open position where it opens said conduit, said kinematic link including a lever articulated on said valve between a first inactive position where said lever is not displaceable by said control member and a second active position where said lever may be displaced by said control member such that, when said valve is in said closed position and said lever is in said first inactive position, said valve cannot be actuated by said control member, said sensor being configured such that upon said sensor detecting fastening of the nozzle to the adaptor, said sensor displaces said lever from said first position towards said second position of said lever whereby said valve may be moved from said closed position to said open position by said control member, wherein said control member is a trigger articulated on the nozzle and provided with a profiled guide which forms a first part receiving an element secured to said lever without permitting movement of said lever by said trigger, said profiled guide forms a second part which has a geometry different than that of said first part, said element moves along a profile of said first part when said lever is in said first inactive position, and moves along a profile of said second part when said lever is in said second position whereby said trigger operates said lever to move said valve to said second position.

* * * * *